US010647126B2

(12) United States Patent
Williams et al.

(10) Patent No.: US 10,647,126 B2
(45) Date of Patent: May 12, 2020

(54) PRINTING SUBASSEMBLY

(71) Applicant: Hewlett-Packard Development Company, L.P., Houston, TX (US)

(72) Inventors: Kenneth Williams, Vancouver, WA (US); Matt G Driggers, Vancouver, WA (US); Bruce A McFadden, Vancouver, WA (US); William Osborne, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/082,608

(22) PCT Filed: Oct. 31, 2016

(86) PCT No.: PCT/US2016/059780

§ 371 (c)(1),
(2) Date: Sep. 6, 2018

(87) PCT Pub. No.: WO2018/080548

PCT Pub. Date: May 3, 2018

(65) Prior Publication Data

US 2019/0092028 A1 Mar. 28, 2019

(51) Int. Cl.

| | |
|---|---|
| ***B41J 25/34*** | (2006.01) |
| ***B41J 2/175*** | (2006.01) |
| ***B41J 2/165*** | (2006.01) |

(52) U.S. Cl.

CPC ..... *B41J 2/1752* (2013.01); *B41J 2/16517* (2013.01); *B41J 2/16547* (2013.01); *B41J 2/175* (2013.01); *B41J 25/34* (2013.01)

(58) Field of Classification Search

CPC ..... B41J 2/1752; B41J 2/16547; B41J 2/175; B41J 25/34

See application file for complete search history.

(56) References Cited

U.S. PATENT DOCUMENTS

| | | | |
|---|---|---|---|
| 6,595,619 | B2 | 7/2003 | Barinaga et al. |
| 8,042,910 | B2 | 10/2011 | Ray et al. |
| 8,205,965 | B2 | 6/2012 | Scheffelin et al. |
| 2008/0174636 | A1 | 7/2008 | Kim et al. |
| 2009/0295872 | A1 | 12/2009 | Ray |
| 2010/0259580 | A1 | 10/2010 | Tsuji |
| 2012/0169821 | A1 | 7/2012 | Meier et al. |
| 2012/0194607 | A1 | 8/2012 | Iwasa et al. |

FOREIGN PATENT DOCUMENTS

| | | | |
|---|---|---|---|
| JP | 2012158036 | A | 8/2012 |

OTHER PUBLICATIONS

Hewlett-Packard Development Company, L.P. Technology Backgrounder: HP T300 Color Inkjet Web Press. Aug. 2009~16 pages.

*Primary Examiner* — Sharon A. Polk
(74) *Attorney, Agent, or Firm* — Dicke Billig & Czaja PLLC

(57) ABSTRACT

A printing subassembly is disclosed. The printing subassembly includes a printbar. A frame is coupled to the printbar such that the printbar dos not move with respect to the frame. A fluid supply system is coupled to the printbar.

15 Claims, 3 Drawing Sheets

PRINTING SUBASSEMBLY

BACKGROUND

Printing devices—including printers, copiers, fax machines, multifunction devices including additional scanning, copying, and finishing functions, all-in-one devices, or other devices such as pad printers to print images on three dimensional objects and three-dimensional printers (additive manufacturing)—receive digital images or digital models and produce objects or images on media such as plain paper, photo paper, transparencies, and other media. In some examples, printing devices are sheet fed devices can print on media stacks of metals and polymeric media in addition to or instead of broad and thin media. Media is positioned as a media stack in an input media tray or on a media roll. Images can be obtained directly from the printing device or communicated to the printing device from a remote location such as from a computing device or computing network. In the example of a sheet fed device, a sheet is selected from the media stack, typically one item at a time, and fed through a media support along a feedpath to an output tray. In a roll fed device, a web of media is fed through a media support along the feedpath to an output. The media interacts with print heads at the media support to produce images on the media. Three-dimensional printers receive a digital model or other data source of an object and can form successive layers of material to produce a three-dimensional object, such as via printer heads, extrusion, sintering-based processes or other processes.

DETAILED DESCRIPTION

Many commercially used printing device, such as inkjet printers in offices, schools, and laboratories, are repaired on site rather than being returned to a factory. A technician is often dispatched in short order to the printer where the maintenance is performed based on a service contract. If repairs are too frequent and too involved, business suffers or users become frustrated with the inability to use the printing device or the expense of the service contract.

In many examples, commercially used printing devices are sturdily built but difficult to repair. In one example, a printing device may have a difficult to repair printbar, which includes a set of print heads spanning a width of media, and may be prone to fail from time to time. The repair of a printbar may involve initially removing the scanner or document feeder and disassemble part of the components of the feedpath and data cables. If a printbar has failed or is in disrepair, it is likely that associated parts such as drive motors, gears, bearings, and other features are also nearing the end of service life. These parts can also be difficult to repair and are also replaced one-by-one often in separate service visits. The repair of difficult to access small parts at various service intervals can lead to costly repair visits for relatively inexpensive components, repeated service visits, and long repair times.

Figure 1:
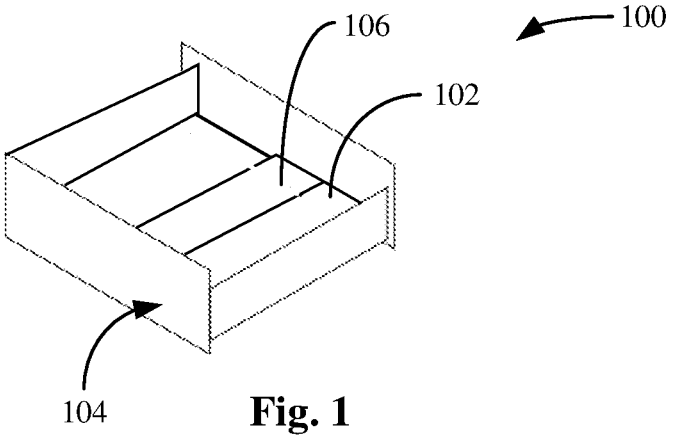
FIG. 1 is a schematic diagram illustrating an example printing subassembly.

FIG. 1 illustrates an example printing subassembly 100, which can include a replaceable printing subassembly for use in a printing device. The printing subassembly 100 includes a printbar 102. The printbar 102 is coupled to a frame 104 such that the printbar 102 does not move relative to the frame 104. A fluid delivery system 106 is coupled to the printbar 102 and the frame 104.

The printing subassembly 100, in one example, includes the printbar 102 and fluid delivery system 106 to provide ink to the printbar 102 and may include other components coupled to the frame 104 that are not intended to be repaired or repaired in the field. Instead, a replaceable printing subassembly 100 can be removed from the printing device and replaced with a new subassembly.

Figure 2:
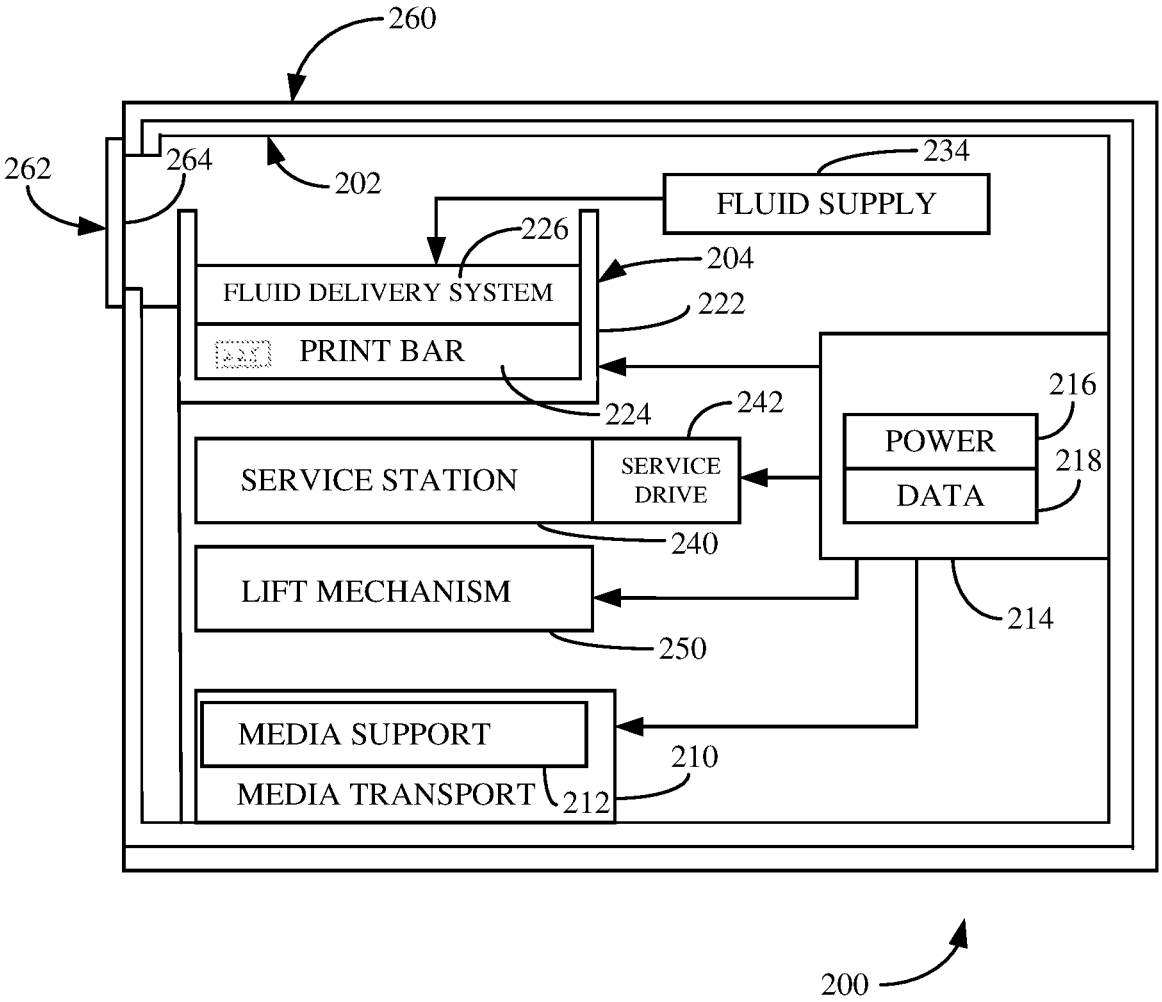
FIG. 2 is a schematic diagram illustrating an example of a printing device including a replaceable printing subassembly such as the printing subassembly of FIG. 1.

FIG. 2 illustrates an example printing device 200 having a chassis 202 operably coupled to an installed replaceable printing subassembly 204. The replaceable printing subassembly 204 can be an example of the printing subassembly 100. In one example, printing device 200 is a commercially used inkjet printer.

Exemplars of a printing device suitable for accepting the replaceable printing subassembly can include one or combinations of two or more of a printer, scanner, copier, fax machine, plotters, or other devices such as pad printers or three-dimensional printers. The printing device can be operated as one or combinations of two or more of a stand alone device, a device coupled to a computer network, or a peripheral or auxiliary device operated by a computer or other processing device. In one example, the printing device is an inkjet printer. Print media can include paper, plastic, fabric, in various sizes and types, such as sheets of paper, roll feed media, and other media. The disclosure includes examples in the context of inkjet printing on a medium for illustration, and the examples are not intended limited to be limited to ink or printing on media, and can include dispensing, ejecting, or otherwise depositing of fluids other than ink for uses other than printing on media.

The printing device 200 can include an media transport system 210 having a media support 212 adapted to present media for marking with the printing subassembly 204. For example, the media transport system 210 can include mechanisms to deliver and present media in the form of sheets or a web roll to the subassembly 204 for printing. A controller 214, which can include a processor, a memory device, and communication circuitry, is operably coupled to the media transport system 210 to control the media transport system 210. The controller 214 can include a power circuit 216 and image processing circuitry 218 coupled to the printing subassembly 204 to provide power and data, such as image data, to operate the subassembly 204.

The printing subassembly 204 in the example includes a frame 222, printbar 224, and fluid delivery system 226. The frame 222 can be removably coupled to the chassis 202, and can include coupling and locating features that selectively position the frame with respect to components of the printing device 200, such as the media support 212. The controller 214 can be operably coupled with signal connections to selectively operate the printbar 224 and dispense ink via the fluid delivery system 226. The fluid delivery system 226 that is in fluid communication with the printbar 224 and a fluid supply 234. The fluid supply 234 can include a replaceable or refillable ink supply, to provide ink or other material to the printbar 224 for printing on media.

The printbar 224 includes an elongate element having one or more print heads, such as print head 225, for dispensing ink. In one example, the printbar 224 spans the width of print media on media support 212 such that the printbar 224 does not traverse back and forth across the width of the print media to dispense ink and the printbar 224 does not otherwise move with respect to the frame 222.

Printbar 224 includes one or more pens for printing. In one example, the printbar 224 includes multiple pens arranged end-on-end in an array on the printbar 224 with part of each pen overlapping a part of an adjacent pen along the span of the printbar. A printbar 224 can include, for example, two or more rows of pens in a staggered configuration in which one pen in each row extends into the overlap between pens for seamless printing across the entire span or much of the span of the printbar. In one example, the configuration of the pens can provide for seamless printing across the full span of the print media.

Pens include mechanisms configured to eject a fluid onto media such as ink, for instance, on a web or sheet. Each pen can include one or more print heads and a self-contained reservoir or cache of fluid that is applied to the print heads. Each print head can include one or more printing dice. For example, a print head can include a die configured to print cyan and magenta ink and another die can be configured to print black and yellow ink. In one example, print heads include thermal resistive drop-on-demand inkjet print heads. In another example, print heads can include piezo-resistive inkjet print heads. In still another example, print heads may comprise other mechanisms configured to eject fluid in a controlled manner.

In the example of thermal resistive inkjet print heads, a heating element is located with individualized nozzles that eject ink. An electric current is applied to heat the heating element and cause a small volume of ink to rapidly heat and become vaporized. Vaporized ink forms a pressurized bubble that ejects fluid ink through the nozzle as the ink expands. A print head driver circuit is coupled to the individual heating elements to provide energy pulses and control the ejection of liquid ink and thus the deposition of ink drops from the nozzles. The print head drivers are responsive to character generators and other image forming circuitry, which can be included as part of controller, for example, to energize selected nozzles of the print head to form images on the print media.

The printing device 200 can include a service station 240 to clean the printbar 224 and a cap to cover the printbar 224 when not in use. The service station 240 can also include, or be operably coupled to a service drive 242 and actuated by the controller 214 with signal connections to move the service station 240 with respect to the printbar 224. In one example, the service station 240 is coupled to the printbar 224 and is included with the replaceable printing subassembly 204 and attached to frame 222. In another example, the service station 240 is not included with the replaceable printing subassembly 204 and is operably coupled to the chassis 202.

The printing device 200 can include a lift mechanism 250 to position the media support 212 with respect to the printbar 224. The lift mechanism 250 is operably coupled to the controller 214 via signal connections to selectively actuate the lift mechanism 250. Because the printbar 224 does not move with respect to the frame 222, the lift mechanism 250 in one example is coupled to the media support 212, and the lift mechanism 250 selectively moves the media support 212 with respect to the chassis 202 to position the printbar 224 with respect to the media support 212. In another example, the lift mechanism 250 is coupled to the frame 222, and the lift mechanism 250 in this example selectively moves the frame with respect to the chassis 202 to position the printbar 224 with respect to the media support 212.

The lift mechanism 250 can be used to finely position the printbar 224 in a particularly selected distance from a media support 212, such as "pen-to-paper spacing," in response to signals provided from a controller 214 based on the type of print media and other considerations. Additionally, the lift mechanism 250 can be used to separate the printbar 224 from the media support 212 in order to apply the service station 240 to the print heads. The lift mechanism 250 can selectively move the printbar 224 relative to the media support 212 from a printing position, in which the print heads are proximate to the print media to one or more service positions in which the service station 240 may clean or cap the printbar 224 when the print heads are not printing.

The lift mechanism 250 can include a motor and a drive operated in response to signals from the controller 214. The drive can include gears or other mechanism to cause the media support 212 to move with respect to the printbar 224 and frame 222 along a lift guide. The lift guide can include a rack coupled to the chassis 202, and the motor is operably coupled to a pinion that engages the rack. The motor can selectively locate the pinion with respect to the rack to position the printbar 224 with respect to the frame 222.

In the illustrated example, the chassis 202 is coupled to and surrounded by a housing 260. The housing 260 can include an opening 262, and a cover 264 is selectively placed over an opening 262. In one example, the cover 264 can be detached, i.e., removably attached, from the housing 260 to expose the subassembly 204 within the housing 260 via the opening 262. In another example, the cover 264 remains attached to the housing 260, such as via a hinge or other mechanism, and is selectively moved away from the opening 262 to provide access to the subassembly 204. In one example, the opening 262 is large enough to allow a technician to detach the subassembly 204 from the chassis 202 and from the controller 214 and remove the subassembly 204 through the opening 262. The mechanical fasteners to fasten the subassembly 204 to the chassis 202 and signal connectors to couple the subassembly 204 to the controller 214 are readily accessible via the opening 262 to remove the subassembly 204. Further, a replacement subassembly can be reattached to the controller and connected to the chassis 202 via the opening 262. Another example housing includes multiple openings including an opening to access the fasteners and electrical connections to the subassembly 204.

Figure 3:
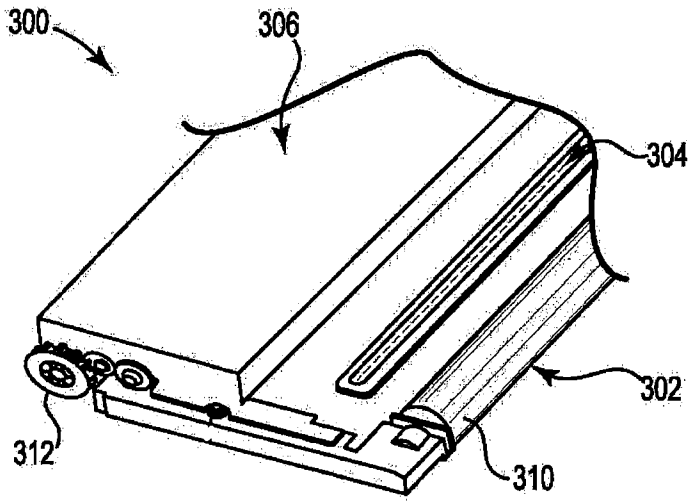
FIG. 3 is a schematic diagram illustrating an example feature included on an example printing subassembly, such as the example printing subassembly of FIG. 1.

FIG. 3 illustrates an example service station 300 generally corresponding with service station 240. During printing, ink tends to build up at the nozzles of the print head. Ink build-up or residual ink can be caused from ink droplets that are not completely ejected, excess ink around the nozzle, and ink splatter reflected from the print media. The nozzles are also susceptible to being clogged from dust, quick drying ink, ink solids, and media particles.

Service station 300 includes a wipe mechanism 302 to clean and preserve the functionality of the print heads and a cap 304 to cover the print heads when not in use to reduce the likelihood of ink drying or contaminants from collecting in and over the nozzles. In one example of the service station being carried on the frame 222, service station 300 is operably coupled to the frame 222 via a service guide (not shown). In an example of the service station 300 being carried on the chassis 202 and not on the replaceable printing subassembly 204, the service guide is coupled to the chassis 202. Service station 300 can also include, or be operably coupled to, a service drive 306 to move the service station 300 with respect to the frame 222 and printbar 224 along the service guide in response to signals from the controller 214.

The wipe mechanism 302 can include a web roll and a feed mechanism. The feed mechanism can include two spools, such as a feed supply and a take up reel, between which an exposed region of web roll 310 is wound. In one example, the spools are operably coupled to gear or cogwheel 312, which can be selectively engaged with a pawl to advance the web roll. The web roll can be advanced in response to signals from a controller 214, which can base a determination of whether to advance the web roll on such factors including health of the printbar, frequency of use, and timing of last wipe.

The cap 304 can be configured to fit and generally seal the dice of the printbar 224. In one example, the cap 304 is formed of a compliant material such as an ethylene propylene diene monomer (M-class) (EPDM) rubber or other elastomer suitable for sealing the print heads and inhibiting the print heads from drying and accumulating contaminants when not in use. In one example, the cap 304 can include a miniature vent to allow air pressure within the cap to slowly adjust to ambient pressure. The print heads can be capped in response to signals from the controller 214, which can base a determination of whether to cap on such factors as time between print jobs or whether the printing device has stopped printing, been powered off, or whether the subassembly 204 is being removed from the printing device 200.

The service drive 306 can selectively position the service station 300 with respect to the frame 222 and printbar 224 along the service path of travel between a wiping position to wipe the printbar with the exposed portion of the web roll 310, a capping position to cover the printbar 224 with the cap 304, and one or more other positions to permit the lift mechanism 226 to locate the media support 212 with respect to the printbar 224 in a printing position.

Figure 4:
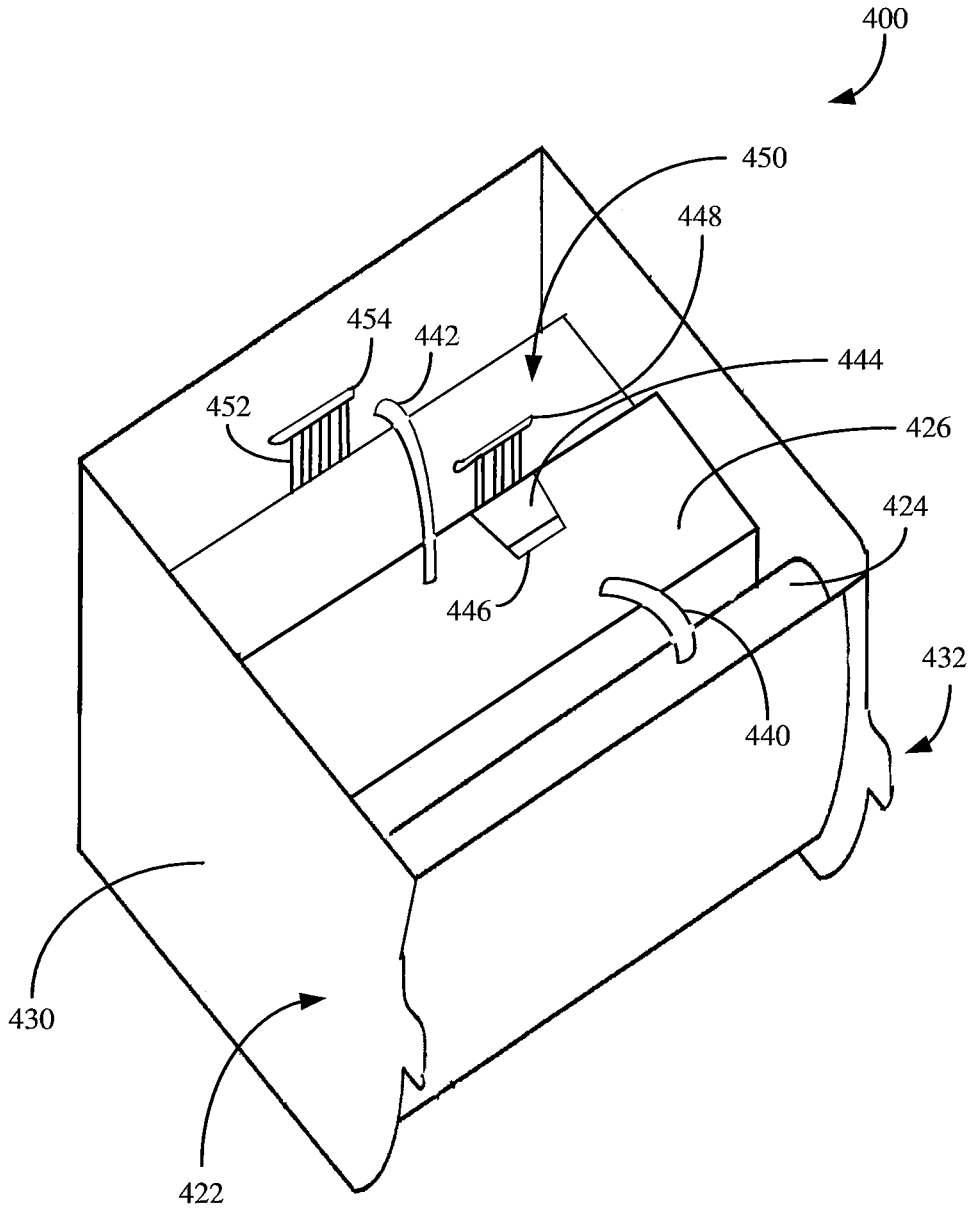
FIG. 4 is a schematic diagram illustrating another example of a printing subassembly of the example printing subassembly of FIG. 1.

FIG. 4 illustrates an example subassembly 400 having a frame 422, printbar 424, and fluid delivery system 426 constructed in accordance with subassemblies 100, 204. In the example, the printbar 424 and the fluid delivery system 426 are not configured to move via mechanisms with respect to the frame 422.

Frame 422 includes a set of upstanding walls 430 punched or cut from a generally rigid material such as sheet metal. In one example, four upstanding walls 430 of the frame 422 surround the printbar 424 and fluid delivery system 426. The frame 422 can include an alignment system 432 having one or more protuberances extending from the frame such as flanges or tabs, or openings such as slots or holes. The alignment system 432 can be used to correctly position and fully constrain the rigid printing subassembly 400 within a printing device in all six degrees of freedom of motion. The alignment system 432 is configured to mate with or attach to corresponding features in the printing device, such as on a chassis of the printing device, to constrain the printing subassembly 400. The frame 422 can include other features, such as holes, to receive fasteners such as screws to attach the subassembly 400 to the chassis of the printing device.

The fluid delivery system 426 in the example does not include a fluid pump to supply ink to the printbar 424. In the example, a tube 440 is used to couple the fluid delivery system 426 to the printbar 424 and provide in to the printbar 424. Because the printbar 424 is not configured to move via mechanisms with respect to the fluid delivery system 426, and thus less stresses are placed on the tube 440, a larger diameter tube can be used than if the fluid delivery system 426 moved with respect to the printbar 424. Without being bound to a particular theory of operation, the larger diameter tube is able to feed ink to the printbar 424 without the aid of a pump such as via capillary action.

In contrast, a printbar movable with respect to the frame via a lift mechanism to selectively position the printbar next to the media support includes a smaller diameter tube connecting an ink delivery system to the printbar. The smaller diameter tube is able to withstand stresses placed on it from the printbar moving with respect to the ink delivery system.

The fluid delivery system 426 can include additional tubing 442 to be coupled to a fluid supply, such as the ink supply, and be coupled to the ink supply via needle and septum for each container of fluid, such as a container for each color of ink or bonding agent. The fluid delivery system 426 includes components and elements to provide fluid from the fluid supplies to the printbar 424. Additionally, the fluid delivery system 426 can include circuitry 444 and sensors 446 to detect fluid supply levels, and other fluid-related parameters or information, and to provide electrical signals to a controller on the printing device, such as controller 214, via an electrical interconnect 448.

Subassembly 400 can include circuitry 450 to connect appropriate power and actuation signals to the printbar 424 and fluid delivery system 426 and to a service station, such as service station 300, if included on the subassembly 400. In one example, the circuitry 450 is included on one or more printed circuit assemblies that includes one or more flat flexible circuits 452 having signal connectors 454 that can be operably coupled receive power and data signals from a controller, such as controller 214. In one example, the flat flexible circuits 452 are configured not to overlap in order to reduce cross-talk or electromagnetic interference. The fixed position of signal lines in the flat flexible circuits 452 avoid overlap if components of the subassembly were separately installed or repaired and care was not given to the corresponding wiring attached to the controller.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printing subassembly for use with a printing device, comprising a printbar;

a frame removably couplable to the printing device, the frame coupled to the printbar such that the printbar is not movable with respect to the frame; and a fluid supply system coupled to the printbar, the fluid supply system having a fluid delivery system coupled to the printbar and to the frame such that the fluid delivery system is not movable with respect to the frame.

2. The printing subassembly of claim 1 wherein the printbar includes a print head in fluid communication with the fluid supply system.

3. The printing subassembly of claim 2 wherein the printbar includes a plurality of print heads.

4. The printing subassembly of claim 2 wherein the fluid delivery system does not include a pump.

5. The printing subassembly of claim 1 including circuitry to connect power and data to the printbar.

6. A printing device, comprising:

a chassis;

a media support mechanism; and a replaceable printing subassembly including, a printbar, a fluid delivery system coupled to the printbar, and a frame removably coupled to the chassis, the printbar fixed to the frame wherein the fluid delivery system and the printbar do not move with respect to the frame.

7. The printing device of claim 6 including an inkjet printer.

8. The printing device of claim 7 wherein the inkjet printer is sheet fed.

9. The printing device of claim 6 wherein the chassis includes a housing having an opening and wherein the subassembly is accessible from the opening.

10. The printing device of claim 6 wherein a drive mechanism moves the media support mechanism with respect to the frame.

11. The printing device of claim 6 comprising a controller having detachable signal pathways operably coupled to the subassembly to connect power and data to the printing subassembly.

12. The printing device of claim 11 wherein the detachable signal pathways include flat flexible circuits.

13. The printing device of claim 6 wherein the subassembly includes a fluid supply in fluid communication with the fluid delivery system and coupled to the frame.

14. A replaceable printing subassembly, comprising a printbar;

an ink delivery system in fluid communication with the printbar, the ink delivery system stationary with respect to the printbar;

a frame fixed to the printbar, the frame coupled to the ink delivery system such that the ink delivery system and the printbar do not move with respect to the frame; and a service station operably coupled to the frame and having a wiper to clean a print head and cap to cover the print head when not in use.

15. The replaceable printing subassembly of claim 14, wherein the printbar has a width and a plurality of print heads span the width.

* * * * *